US006412193B1

(12) United States Patent
Chen

(10) Patent No.: US 6,412,193 B1
(45) Date of Patent: Jul. 2, 2002

(54) WATERPROOF SHOE HAVING STITCH SEAM FOR DRAINAGE (I)

(76) Inventor: Eddie Chen, 4F, No. 255, Sec. 1, Taichung-Kang Rd., Taichung City (TW)

( * ) Notice: Subject to any disclaimer, the term of this patent is extended or adjusted under 35 U.S.C. 154(b) by 0 days.

(21) Appl. No.: 09/591,591

(22) Filed: Jun. 9, 2000

(51) Int. Cl.[7] ..... A43B 9/10; A43B 9/02

(52) U.S. Cl. ..... 36/14; 36/55; 36/16; 36/17 R; 36/18

(58) Field of Search ..... 36/12, 14, 55, 36/16, 17 R, 18

(56) References Cited

U.S. PATENT DOCUMENTS

| | | | | | |
|---|---|---|---|---|---|
| 737,244 | A | * | 8/1903 | Jackson | |
| 1,469,831 | A | * | 10/1923 | Gorman | |
| 2,429,354 | A | * | 10/1947 | Glass | |
| 3,736,613 | A | * | 6/1973 | Tusa et al. | 12/142 D |
| RE34,890 | E | * | 4/1995 | Sacre | 36/55 |
| 5,499,459 | A | * | 3/1996 | Tomaro | 36/10 |
| 5,732,429 | A | * | 3/1998 | Strickland | 12/142 D |
| 6,065,227 | A | * | 5/2000 | Chen | 36/4 |

* cited by examiner

*Primary Examiner*—Ted Kavanaugh
(74) *Attorney, Agent, or Firm*—Fish & Richardson P.C.

(57) ABSTRACT

A waterproof shoe includes a hollow sole pad having an intermediate opening, an inner marginal end confining the opening, an outer marginal portion spaced from and extending around the inner marginal end, and an upstanding flange which projects from the sole pad between the outer marginal portion and the inner marginal end and which loops around the opening. An upper has a bottom open end stitched to one of the outer marginal portion and the upstanding flange. A lining sleeve is disposed inside the upper and is made of a material which is impervious to water but is pervious to vapors. The lining sleeve has a bottom open end stitched to the upstanding flange of the sole pad to form a stitch seam which is then sealed by means of waterproof means. The bottomless lining sleeve and the hollow sole pad permits the lining sleeve to be secured and sealed watertight to the sole pad in a less complicated manner. Drainage is permitted at the stitch seam of the sole pad and the upper.

6 Claims, 5 Drawing Sheets

WATERPROOF SHOE HAVING STITCH SEAM FOR DRAINAGE (I)

BACKGROUND OF THE INVENTION

1. Field of the Invention

The invention relates to a waterproof shoe, more particularly to a waterproof shoe which has an upper and a bottomless waterproof breathable lining sleeve having a bottom open end stitched to a sole pad and which has a drain outlet at the stitched seam of the upper, the lining sleeve and the sole pad.

2. Brief Description of the Related Art

Conventional waterproof shoes generally include an outer shell made of a waterproofing material which is impervious to air and vapor. Such waterproof shoes tend to cause discomfort to the wearer as ventilation of perspiration vapors gathered around the wearer's feet is not permitted. Improvements available in the art for coping with such perspiration problems include the use of a non-waterproof material, such as leather or fabric, for the outer shell of an upper and the use of a sock-like liner, which is made of a material or laminate impervious to water but pervious to perspiration vapors, as a protection part for the foot against water intrusion. In particular, shoe constructions with such an improvement generally include a sock-like liner which has a top open end secured to the top open end of an upper, and a bottom wall seating on and bonded adhesively to a midsole which is secured to the bottom end of the upper. A disadvantage found in such constructions is that water can seep into the interior of the shoe through the seams of the shoe and can be trapped in the space between the upper and the sock-like liner.

Attempts have been made in order to alleviate the aforesaid water seeping problems by improving the waterproofing characteristics of the waterproof breathable shoes. U.S. Pat. No. 5,678,326 suggests an improved shoe construction which comprises an outer shell connected to an insole, a waterproof, water-vapor permeable shoe insert disposed inside the outer shell, and a lining provided inside the shoe insert. Both of the lining and the shoe insert have their bottom walls extending between an outsole and an insole, and are secured to the bottom portion of the upper and to the outsole and insole by using several layers of adhesive.

As described hereinabove, the prior art addressed the aforesaid water seeping problem by focusing on improvements in the waterproofing characteristics of the shoes. The technical measures taken in the art to enhance the waterproofing characteristics, however, tend to reduce the ventilating characteristics and vapor permeability of shoes.

The basic U.S. application of this application which is numbered Ser. No. 09/209597 discloses a waterproof boot construction which is designed to provide a drain outlet for the water invading the boot. The boot construction as disclosed therein comprises an outer shell having an upper of non-waterproof material and a lower of waterproof material and utilizes a waterproof, water-vapor permeable inner lining sleeve to line the upper. The bottom ends of the upper and the lining sleeve are stitched to a top end of the lower, and a water-tight seal is provided inside the lining sleeve and the lower so that the water seeping through the stitched seam into the space between the lining sleeve and the upper is prevented from invading the interior of the lining sleeve and the lower and is diverted to the stitched seam for drainage. The drain outlet formed as such is located along the stitched joint of the overlapping parts of the upper and the lower of the boot.

U.S. Pat. No. 4,599,810 discloses stitchdown shoes which incorporate waterproof, vapor permeable sock-like liners and which provide good ventilating property. In the construction of these shoes, although a stitchdown formed at the joint of a midsole and an upper permits ventilation, since a padding, which is typically made of a fibrous or foamed material, is disposed between the inner surface of the upper and the sock-like liner, the water penetrating through the stitchdown can be retained in the padding due to the water-wicking property of the padding. The wet padding not only adds weight to the shoe but also reduces the warmness of the shoe. On the other hand, the sock-like liner used in this shoe construction has a bottom wall which seats on a midsole and is secured adhesively thereto. The need to provide the liner with the bottom wall complicates the process of making the shoe and increases the consumption of expensive waterproof, vapor permeable material. The procedure for securing adhesively the bottom wall of the liner to the midsole is also cumbersome and time-consuming.

SUMMARY OF THE INVENTION

An object of the present invention is to provide a waterproof shoe which permits the wearer's feet to breathe and which has a drain outlet for the water invading the interior of the shoe.

Another object of the present invention is to provide a waterproof breathable shoe which can be produced via a less complicated process with reduced consumption of expensive waterproof breathable material.

According to one aspect of the present invention, a waterproof shoe comprises: a hollow sole pad having an intermediate opening, an inner marginal end confining the, opening, an outer marginal portion spaced from and extending around the inner marginal end, and an upstanding flange which projects from the sole pad between the outer marginal portion and the inner marginal end and which loops around the opening; an upper having a top end, and a bottom open end stitched to one of the outer marginal portion and the upstanding flange; and a lining sleeve disposed inside the upper, the lining sleeve being made of a material which is impervious to water but is pervious to vapors, and having a top end connected to the top end of the upper, and a bottom open end extending substantially along the inner surface of the bottom open end of the upper and stitched to the upstanding flange to form a stitch seam. The shoe further comprises waterproof means secured adhesively to the inner surface of the lining sleeve and the inner surface of the upstanding flange along the stitch seam.

According to another aspect of the present invention, a waterproof shoe comprises a sole pad having an outer marginal portion, and an upstanding flange projecting upward from the sole pad and extending inwardly of and adjacent the outer marginal portion, the flange looping substantially along the outer marginal portion; an upper having a top end, and a bottom open end stitched to one of the outer marginal portion and the upstanding flange; and a lining sleeve disposed inside the upper, the lining sleeve being made of a material which is impervious to water but is pervious to vapors, and having a top end connected to the top end of the upper, and a bottom open end extending substantially along the inner surface of the bottom open end of the upper and stitched to the upstanding flange to form a stitch seam. Waterproof means is secured adhesively to the inner surface of the lining sleeve and the inner surface of the upstanding flange along the stitch seam.

BRIEF DESCRIPTION OF THE DRAWINGS

Other features and advantages of the present invention will become apparent in the following detailed description of the preferred embodiments with reference to the accompanying of which.

DETAILED DESCRIPTION OF THE PREFERRED EMBODIMENTS

Figure 1:
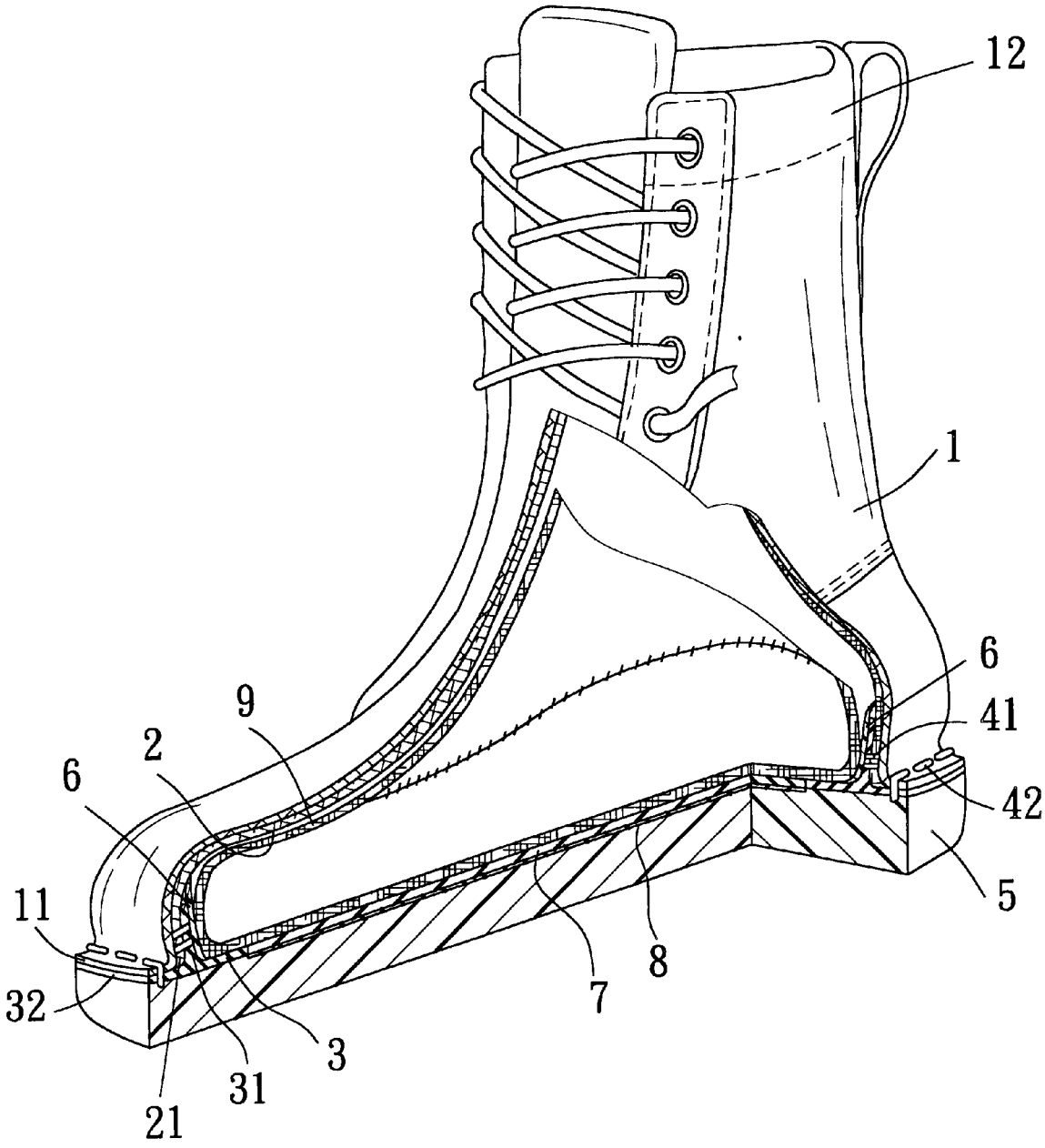
FIG. 1 a partially sectioned perspective view of a waterproof breathable shoe embodying the present invention.
Figure 2:
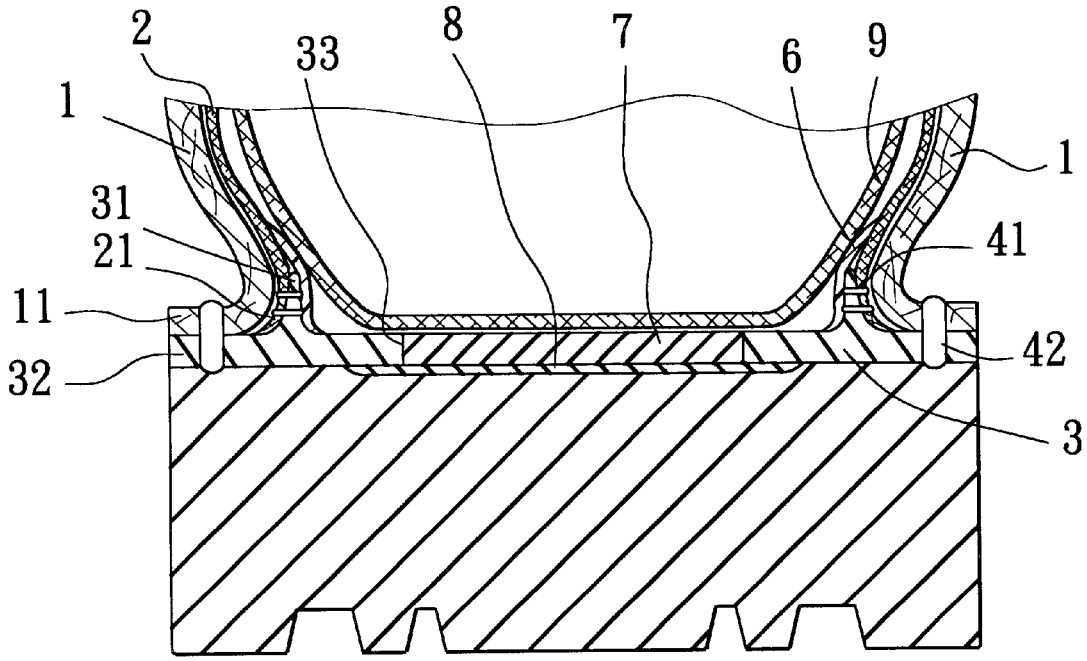
FIG. 2 is a fragmentary sectional view of the shoe of FIG. 1.
Figure 3:
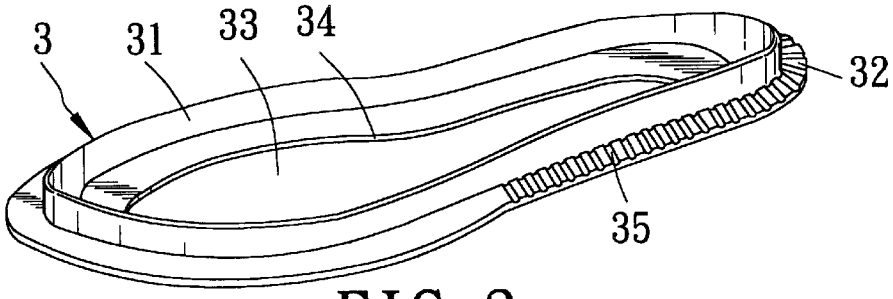
FIG. 3 is a perspective view showing a one-piece sole pad used in the shoe of FIG. 1.

Referring to FIGS. 1, 2, and 3, a stitchdown shoe embodying the present invention is shown to include an upper 1 which is lasted in a conventional manner to form an outwardly turned bottom end 11 and which is stitched to a hollow sole pad 3 by a conventional stitchdown process. The sole pad 3 is made of a waterproof material, such as PU, PVC or rubber. As best shown in FIG. 3, the sole pad 3 includes an intermediate opening 33, an inner marginal end 34 confining the opening 33, an outer marginal portion 32 spaced from and extending around the inner marginal end 34, and an upstanding flange 31 which is provided between the outer marginal portion 32 and the inner marginal end 34 and which loops around the opening 33. Aplurality of grooves 35, which extend outward along directions from the upstanding flange 31 to the outer distal end of the outer marginal portion 32, are formed in the top surface of the outer marginal portion 32. The outer marginal portion 32 of the sole pad 3 is stitched to the outwardly turned bottom open end 11 of the upper 1 to form a stitchdown seam 42.

A lining sleeve 2 is disposed inside the upper 1 immediately adjacent the inner surface of the upper without any layer interposed therebetween. The lining sleeve 2 is made of a typical material which is impervious to water but is pervious to perspiration vapors, and has a top open end (not shown) secured to the top open end 12 of the upper 1 in a conventional manner. The lining sleeve 2 further has a bottom open end 21 which extends along the inner surface of the bottom open end of the upper and to the upstanding flange 31 of the sole pad 3 so that the lining sleeve 2 overlaps the upstanding flange 31. The inner surface of the lining sleeve 2 abuts with the outer surface of the upstanding flange 31.

A stitch seam 41 is provided along the overlapping parts of the bottom open end 21 and the upstanding flange 31 and is sealed to be watertight by using a waterproof tape 6. The waterproof tape 6 is adhesively bonded to the inner surface of the bottom open end 21 of the lining sleeve 2 and the inner surface of the upstanding flange 31 of the sole pad 3. In place of the waterproof tape 6, the seam 41 may be sealed watertight by applying a waterproof coating on the inner surfaces of the lining sleeve 2 and the upstanding flange 31. The opening 33 of the sole pad 3 serves to allow easy access to the interior of the lining sleeve 2 for tooling during the process of sealing the stitch seam 41 with the waterproof tape 6 or the other waterproof means, such as a water proof coating.

After the sealing process, the opening 33 is closed and sealed to be watertight by filling the same with a filler 7 and attaching a waterproof cover 8 to the filler 7 and the sole pad 3 in a conventional manner. An outsole is finally attached to the sole pad 3. A conventional inner liner 9 which has a shape substantially conforming to that of the inner surface of the upper 1 is disposed inside the lining sleeve 2 in a conventional manner. If desired, a foot-like padding (not shown) may be disposed on a bottom wall of the inner liner 9 in a conventional manner.

In the construction described above, as there is no interposed water-wicking layer between the upper 1 and the lining sleeve 2, the water penetrating through the seams of the shoes, such as the stitchdown seam 42 and the other seams of the upper 1 will not be trapped between the lining sleeve 2 and the upper 1, and can flow downward to the stitchdown seam 42 to drain out therethrough. On the other hand, since the lining sleeve 2 has no bottom wall, the lining sleeve 2 is permitted to be secured and sealed to the sole pad 3 in a less complicated manner by stitching the bottom open end 21 thereof to the upstanding flange 31 of the sole pad 3 and by providing a waterproof seal at the inner side of the stitch seam 41. The hollow sole pad 3 according to the present invention provides an advantage of facilitating the mounting of the lining sleeve 2 due to the presence of the upstanding flange 31 for positioning the bottom open end 21 of the lining sleeve 2 and due to the presence of the opening 33 that provides easy access to the interior of the lining sleeve 2 for the waterproofing treatment. In addition, the consumption of expensive waterproof, vapor-permeable material for the lining sleeve 2 can be reduced because no bottom wall is required in the lining sleeve 2.

Figure 4:
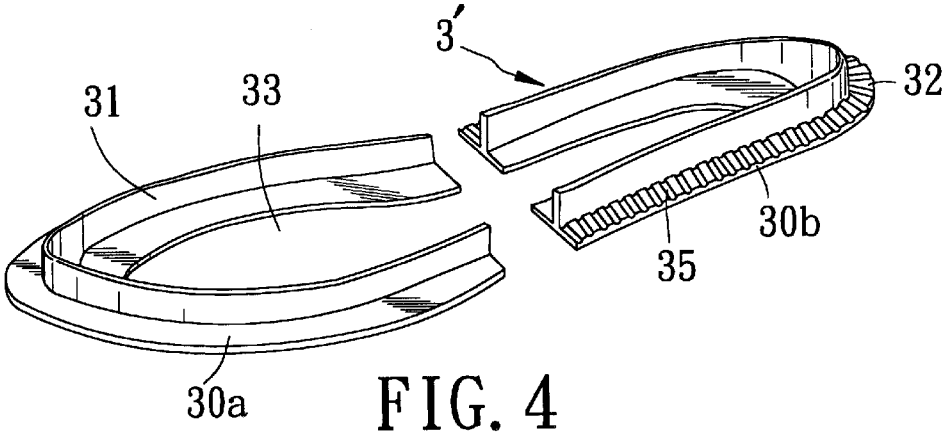
FIG. 4 is a perspective view showing a sole pad comprised of separate pieces and used in the shoe of FIG. 1.
Figure 5:
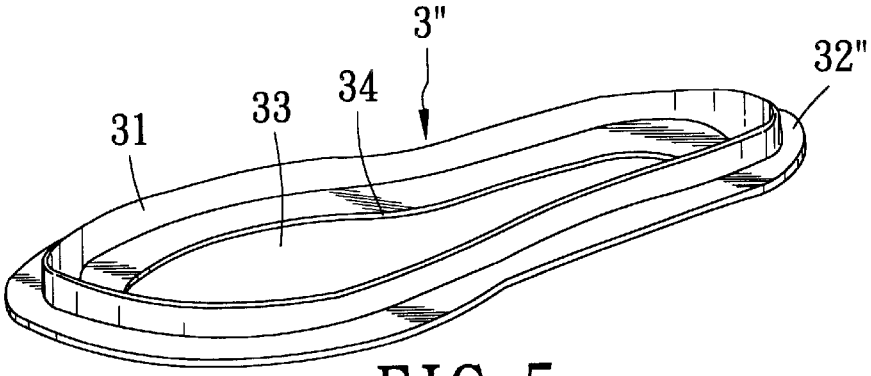
FIG. 5 is a perspective vie showing a one-piece sole pad which is not provided with grooves.

Apart from using the single-piece sole pad 3 shown in FIG. 3, the present invention may also employ a sole pad 3' which is constituted of more than one piece, as shown in FIG. 4. The sole pad 3' includes a front section 30*a* and a rear section 30*b* formed with grooves 35. After the front and rear sections 30*a* and 30*b* are assembled together, they serve to provide the same function as the sole pad 3. In place of the sole pad 3, the present invention may also use a sole pad 3" which is not provided with grooves 35 in the outer marginal portion 32' as shown in FIG. 5.

Figure 6:
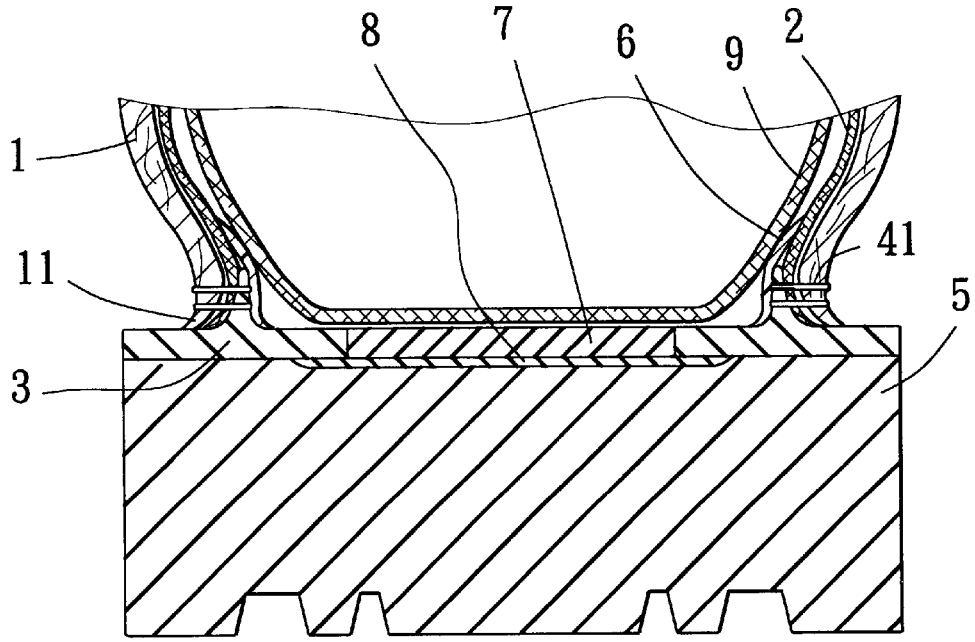
FIG. 6 is the same view as FIG. 2 but with the bottom end of the upper not being turned outwardly.

FIG. 6 shows another embodiment of the waterproof shoe according to the present invention, which differs from the previous embodiment merely in that the bottom open end 11' of the upper 1 is not turned outward and is stitched to the upstanding flange 31, rather than the outer marginal portion 32 of the sole pad 3, together with the bottom open end 21 of the lining sleeve 2.

Figure 7:
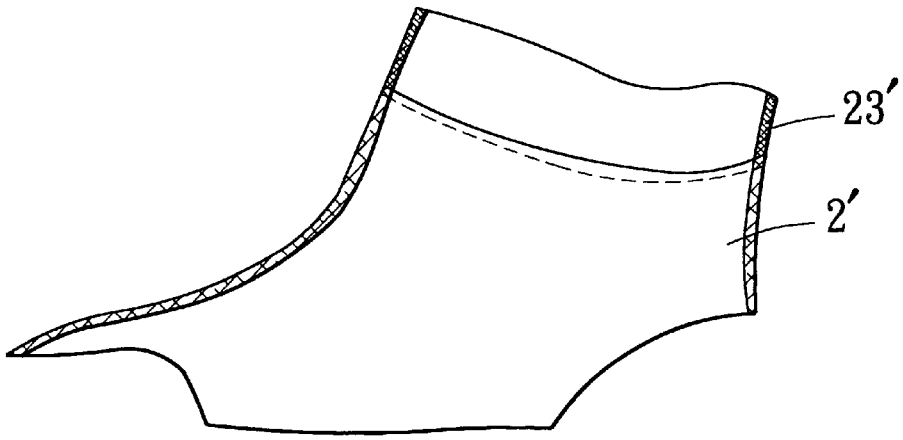
FIG. 7 is a plain view showing a different example of the lining sleeve used in the present invention.

For economical purposes, the cost of the expensive material of the lining sleeve 2 may be reduced by shortening the dimension of the upper part of the lining sleeve 2. An example of the shortened lining sleeve is shown at 2' in FIG. 7, and includes a fabric part 23' stitched to the top open end of the lining sleeve 2' for connection with the top open end of the upper 1. The fabric part 23' is made of a fluid-pervious fabric material.

Figure 8:
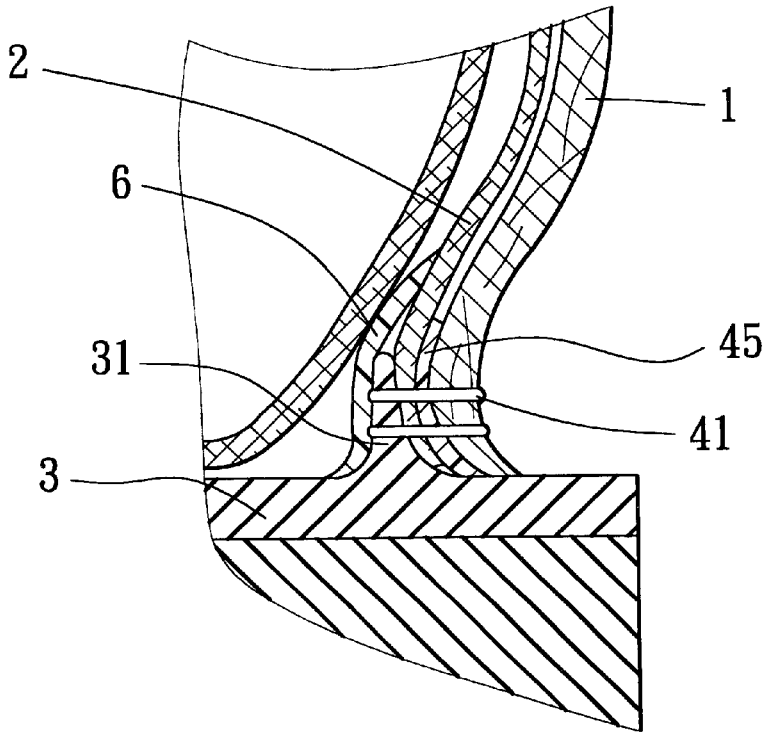
FIG. 8 is a fragmentary view showing that an insert member is disposed between the lining sleeve and the upper along the seam thereof.
Figure 8A:
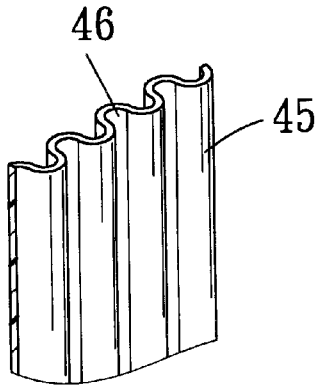
FIG. 8A shows an example of the material of the insert member.
Figure 8B:
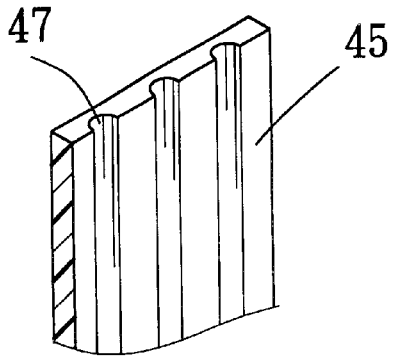
FIG. 8B shows another example of the material of the insert member.

FIG. 8 shows that an insert member 45 is disposed between the bottom open end of the lining sleeve 2 and the inner surface of the bottom open end of the upper 1, and is stitched to the upstanding flange 31 of the sole pad 3 along the seam 41. The construction as such also permits drainage at the seam 41. The insert member 45 may be a molded sheet which is made of a rubber or plastic material and which has a plurality of channels 46 as shown in FIG. 8A, or channels 47 as shown in FIG. 8B, or may be a fabric material which is woven or non-woven.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. A waterproof shoe comprising:

a one-piece hollow sole pad having a top face, a bottom face opposite to said top face, an intermediate opening, an inner marginal end confining said opening, an outer marginal portion spaced from and extending around said inner marginal end, and an upstanding flange which projects upward from said top face of said sole pad between said outer marginal portion and said inner marginal end and which loops around said opening;

an upper having a top end, and a bottom open end, said top face of said sole pad being disposed below said bottom open end, said bottom open end being stitched to one of said outer marginal portion and said upstanding flange;

a lining sleeve disposed inside said upper, said lining sleeve being made of a material which is impervious to water but is pervious to vapors, and having a top end connected to said top end of said upper, and a bottom open end extending above said top face of said sole pad and along the inner surface of said bottom open end of said upper and stitched to said upstanding flange to form a stitch seam above said top face of said sole pad; and a waterproof member secured adhesively to said lining sleeve and said upstanding flange along said stitch seam so as to seal said stitch seam.

2. The waterproof shoe as claimed in claim 1, further comprising a filler disposed in and closing said opening.

3. The waterproof shoe as claimed in claim 1, wherein said outer marginal portion has a plurality of grooves which extend outward along directions from said upstanding flange to a distal end of said outer marginal portion.

4. The waterproof shoe as claimed in claim 1, wherein said sole pad is a single-piece molded pad.

5. The waterproof shoe as claimed in claim 1, wherein said bottom open end of said upper is turned outward and stitched to said outer marginal portion of said sole pad to form a stitchdown seam.

6. The waterproof shoe as claimed in claim 1, wherein said bottom open end of said lining sleeve has an inner surface abutting with an outer surface of said upstanding flange and is stitched to said upstanding flange.

* * * * *